US009078294B2

(12) United States Patent
Doumanidis et al.

(10) Patent No.: US 9,078,294 B2
(45) Date of Patent: Jul. 7, 2015

(54) NANOHEATER ELEMENTS, SYSTEMS AND METHODS OF USE THEREOF

(75) Inventors: Charalabos C. Doumanidis, Nicosia (CY); Teiichi Ando, Belmont, MA (US); Julie Chen, Wilmington, MA (US); Claus G. Rebholz, Nicosia (CY)

(73) Assignees: University of Massachusetts, Boston, MA (US); Northeastern University, Boston, MA (US)

( * ) Notice: Subject to any disclaimer, the term of this patent is extended or adjusted under 35 U.S.C. 154(b) by 1454 days.

(21) Appl. No.: 12/375,823

(22) PCT Filed: Aug. 7, 2007

(86) PCT No.: PCT/US2007/017524

§ 371 (c)(1),
(2), (4) Date: Jan. 30, 2009

(87) PCT Pub. No.: WO2008/021073

PCT Pub. Date: Feb. 21, 2008

(65) Prior Publication Data

US 2009/0235915 A1 Sep. 24, 2009

Related U.S. Application Data

(60) Provisional application No. 60/836,027, filed on Aug. 7, 2006.

(51) Int. Cl.
*F24J 1/00* (2006.01)
*H05B 3/12* (2006.01)

(52) U.S. Cl.
CPC ..... *H05B 3/12* (2013.01); *Y10T 428/265* (2015.01); *F24J 1/00* (2013.01); *H05B 2214/04* (2013.01)

(58) Field of Classification Search
CPC ..... F24J 1/00; F42B 3/18; F42B 3/195; F42B 1/032; F42B 39/00; F42B 39/14; B23K 1/0006; C06B 45/12; C06B 45/14
USPC ..... 126/263.01; 228/234.3; 428/607, 615, 428/635, 940
See application file for complete search history.

(56) References Cited

U.S. PATENT DOCUMENTS 3,163,113 A * 12/1964 Davis et al. ..... 102/289
3,503,814 A * 3/1970 Helms, Jr. et al. ..... 149/37

(Continued)

FOREIGN PATENT DOCUMENTS

WO WO 2005/005092 1/2005
WO WO 2005/035465 4/2005

OTHER PUBLICATIONS

Lo et al., "Self-ordered pore structure of anodized aluminum on silicon and pattern transfer," Applied Physics Letter, vol. 76, No. 1, Jan. 2000.

(Continued)

*Primary Examiner* — Jorge Pereiro
(74) *Attorney, Agent, or Firm* — McCarter & English, LLP

(57) ABSTRACT

The present invention provides devices and methods for making nano structures such a nanoheater. In one embodiment, the nanoheater element comprises a first reactive member and interlayer disposed in communication with at least a portion thereof. Preferably, contact between the first and second reactive members of the nanoheater element can yield at least one exothermic reaction. A nanoheater device of the invention can optionally comprise a substrate on which the first reactive member is positioned in combination with other components. The invention also provides a nanoheater system comprising a plurality of nanoheater elements. Exemplary nanoheater elements and systems can be used to perform a method of the invention in which heat is produced. Methods includes processes for fabricating nanostructures such as layered devices, nanorods and nanowires.

37 Claims, 5 Drawing Sheets

(56) References Cited

U.S. PATENT DOCUMENTS

| | | | | |
|---|---|---|---|---|
| 4,710,235 | A * | 12/1987 | Scruggs | 419/7 |
| 4,783,903 | A | 11/1988 | Pernquist et al. | |
| 4,871,693 | A * | 10/1989 | Inoue et al. | 501/9 |
| 5,089,356 | A | 2/1992 | Chung | |
| 5,253,584 | A * | 10/1993 | Allford | 102/202.7 |
| 5,266,132 | A * | 11/1993 | Danen et al. | 149/15 |
| 5,538,795 | A * | 7/1996 | Barbee et al. | 428/420 |
| 5,547,715 | A * | 8/1996 | Barbee et al. | 427/561 |
| 5,590,383 | A * | 12/1996 | Sekhar et al. | 419/2 |
| 5,591,345 | A * | 1/1997 | Engelen et al. | 210/640 |
| 5,606,146 | A * | 2/1997 | Danen et al. | 149/15 |
| 6,004,450 | A | 12/1999 | Northrup et al. | |
| 6,231,744 | B1 * | 5/2001 | Ying et al. | 205/324 |
| 6,359,288 | B1 * | 3/2002 | Ying et al. | 257/14 |
| 6,534,194 | B2 * | 3/2003 | Weihs et al. | 428/635 |
| 6,553,911 | B1 * | 4/2003 | Walker et al. | 102/202.7 |
| 6,621,159 | B1 | 9/2003 | Kuramachi | |
| 6,645,571 | B1 * | 11/2003 | Takai et al. | 427/553 |
| 6,703,578 | B2 * | 3/2004 | Walker et al. | 219/121.45 |
| 6,705,152 | B2 | 3/2004 | Routkevitch et al. | |
| 6,736,942 | B2 * | 5/2004 | Weihs et al. | 204/192.12 |
| 6,835,910 | B2 * | 12/2004 | Moore et al. | 219/121.45 |
| 6,881,284 | B2 * | 4/2005 | Makowiecki et al. | 149/109.6 |
| 6,914,220 | B2 | 7/2005 | Tian et al. | |
| 6,991,856 | B2 * | 1/2006 | Weihs et al. | 428/635 |
| 7,278,353 | B2 * | 10/2007 | Langan et al. | 102/306 |
| 7,278,354 | B1 * | 10/2007 | Langan et al. | 102/306 |
| 7,354,659 | B2 * | 4/2008 | Duckham et al. | 428/612 |
| 7,441,688 | B2 * | 10/2008 | Van Heerden et al. | 228/102 |
| 7,897,264 | B2 * | 3/2011 | Bunyan | 428/626 |
| 7,923,813 | B2 * | 4/2011 | Van Der Sluis et al. | 257/530 |
| 7,951,247 | B2 * | 5/2011 | Barbee et al. | 149/15 |
| 8,138,105 | B2 * | 3/2012 | Timans | 438/799 |
| 8,328,967 | B2 * | 12/2012 | Barbee et al. | 149/109.6 |
| 8,336,457 | B2 * | 12/2012 | Weihs et al. | 102/202.2 |
| 2003/0150347 | A1 * | 8/2003 | Walker et al. | 102/202.7 |
| 2003/0164289 | A1 * | 9/2003 | Weihs et al. | 204/192.12 |
| 2004/0003907 | A1 * | 1/2004 | Moore et al. | 164/54 |
| 2004/0060625 | A1 * | 4/2004 | Barbee et al. | 149/15 |
| 2004/0234914 | A1 * | 11/2004 | Hale et al. | 431/269 |
| 2004/0234916 | A1 * | 11/2004 | Hale et al. | 431/358 |
| 2005/0079166 | A1 * | 4/2005 | Damani et al. | 424/122 |
| 2005/0142495 | A1 * | 6/2005 | Van Heerden et al. | 430/311 |
| 2005/0276743 | A1 | 12/2005 | Lacombe et al. | |
| 2006/0068179 | A1 * | 3/2006 | Weihs et al. | 428/209 |
| 2006/0219759 | A1 * | 10/2006 | Duckham et al. | 228/234.3 |
| 2007/0023489 | A1 * | 2/2007 | Swiston et al. | 228/262.9 |
| 2007/0224441 | A1 * | 9/2007 | Bunyan | 428/615 |
| 2008/0093418 | A1 * | 4/2008 | Weihs et al. | 228/101 |
| 2008/0110962 | A1 * | 5/2008 | Saxena et al. | 228/123.1 |
| 2008/0124516 | A1 * | 5/2008 | Noguchi et al. | 428/117 |
| 2008/0272181 | A1 * | 11/2008 | Wang et al. | 228/234.3 |
| 2009/0068387 | A1 * | 3/2009 | Panzer et al. | 428/40.1 |
| 2009/0072212 | A1 * | 3/2009 | Van Der Sluis et al. | 257/2 |
| 2009/0242615 | A1 * | 10/2009 | Saxena et al. | 228/198 |
| 2010/0099268 | A1 * | 4/2010 | Timans | 438/761 |
| 2011/0070460 | A1 * | 3/2011 | Weihs et al. | 428/635 |
| 2011/0203714 | A1 * | 8/2011 | Barbee et al. | 156/60 |

OTHER PUBLICATIONS

Sauer et al., "Highly ordered monocrystalline silver nanowire arrays," Journal of Applied Physics, vol. 91, No. 5, Mar. 2002.

Yoon et al., "Electrochemical fabrication of CdS/Co nanowire arrays in porous aluminum oxide templates," Bull. Korean Chem. Soc, vol. 23, No. 11, 2002.

Galaca et al., "Structural and optical characterization of porous anodic aluminum oxide," American Institute of Physics, vol. 94, No. 7, Oct. 2005.

Kuo et al., "Manipulating molecular transport through nanoporous membranes by control of electrokinetic flow: effect of surface charge density and debye length," Published on the web Sep. 8, 2001.

Heremans et al., "Bismuth nanowire arrays: Synthesis and galvanomagnetic properties," Physical Review B, vol. 61, No. 4, Jan. 2000.

Kovtyukhova et al., "Templated surface sol-gel synthesis of $SiO_2$ nanotubes $SiO_2$-insulated metal nanowires," Adv. Mater, 15, No. 10, May 16.

Yin et al., "Fabrication of highly ordered metallic nanowire arrays by electrodeposition," Applied Physics Letters, vol. 79, No. 7, Aug. 2001.

Besnoin et al., "Effect of reactant and product melting on self-propagating reactions in multilayer foils," Journal of Applied Physics, vol. 92, No. 9, Nov. 2002.

* cited by examiner

NANOHEATER ELEMENTS, SYSTEMS AND METHODS OF USE THEREOF

CROSS REFERENCE TO RELATED APPLICATIONS

The present application claims priority to U.S. application Ser. No. 60/836,027, filed Aug. 7, 2006, the entire contents of which is incorporated herein by reference.

STATEMENT REGARDING FEDERALLY SPONSORED RESEARCH OR DEVELOPMENT

Part of the work leading to the present invention was carried out with support from the United States Government provided under a grant from the National Science Foundation, Grant No. DMI-0531127. Accordingly, the United States Government has certain rights in the invention.

BACKGROUND OF THE INVENTION

The fields of nanoscience and nanotechnology concern the synthesis, fabrication and use of elements and systems at atomic, molecular and supramolecular levels. The nanoscale of these elements and systems offers significant potential for research and applications across the scientific disciplines including materials science, engineering, physics, chemistry, computer science and biology. Although active uses of heat to alter geometries, structures or properties in conventional processes often involve macroscale elements or systems, fundamental technical constraints can hinder comparable nanoscale approaches. For example, in structural materials, heat treatment of nanograined metals obtained by severe plastic deformation or sintering of nanopowders into bulk consolidates can be limited by in-process grain growths. Generally, such limitations arise due to characteristic lengths and times of heat transfer in macroscale elements and systems, which are incompatible with spatial or temporal dimensions on the nanoscale. To date, there remains a need for elements and systems on the nanoscale that can enable both fine local heat selectivity and time-exposure control. Such elements and systems may be used in nanoscale manufacturing or on-board thermal actuation and autonomous powering during operation of nanosized devices.

SUMMARY OF THE INVENTION

The present invention provides a nanoheater element, which can be used to produce heat. In one embodiment, the nanoheater element includes a first reactive member. The nanoheater element also includes an interlayer disposed in communication with at least a portion of the first reactive member. The interlayer of the nanoheater element can comprise a membrane. Moreover, the nanoheater element comprises a second reactive member. For example, the second reactive member can be separated from the first reactive member by the interlayer. Preferably, contact or interaction between the first and second reactive members of the nanoheater element can yield at least one exothermic reaction. The nanoheater element of the invention can optionally include a substrate on which the first reactive member is disposed.

An exemplary substrate of the nanoheater element of the invention can include a layer or film. In one embodiment, the substrate has a thickness of about 10 to 100 nanometers (nm). The invention also contemplates that the substrate can have other thicknesses for particular applications, for example, substrates thicker than 100 nm can be used in tooling for moldings or material processing. The substrate can comprise silicon, metals, silicon dioxide, alloys, metal alloys, polymers, glass, refractory metal alloys, ceramics, insulators, composite materials or combinations thereof. As described, the first reactive member of the nanoheater element of the invention can be disposed over the substrate. For example, the first reactive. member can be disposed on the substrate by any suitable conventional technique or process including, without limitation, electroplating, thermal evaporation, chemical vapor deposition, lithography, physical vapor deposition, sputtering, electroless plating, electron beam evaporation, pulsed laser deposition, molecular beam epitaxy and combinations thereof. The first reactive member can also include a layer or film.

Furthermore, the first reactive member of the nanoheater element of the invention can have a thickness, for example, of about 10 to 100 nm. The first reactive member can also comprise a transition metal, metal or combinations thereof. Exemplary transition metals or metals for the first reactive member can include, without limitation, nickel, titanium, magnesium, chromium, cobalt, iron, cadmium, platinum, copper, rhenium, aluminum or combinations thereof. Preferably, the transition metal or metal of the first reactive member comprises nickel or aluminum. In one embodiment, the interlayer of the nanoheater element includes a thickness, without limitation, of about 10 to 100 nm. The interlayer can comprise at least one pore. For example, the pore can have a diameter, without limitation, from about 10 to 50 nm. The interlayer can also comprise at least two pores with average diameters, for example, from about 10 to 50 nm. The pores of the interlayer can each be from about 50 to 100 nm apart.

The interlayer of the nanoheater element of the invention can comprise, without limitation, aluminum oxide, zeolites, anodized aluminum oxide (AAO), aerogels or combinations thereof. In one embodiment, the interlayer of the nanoheater element of the invention can interact with an ignition source. For example, the ignition source can provide for radio frequency pulsation, plasmonic induction, microwave excitation, infrared irradiation or combinations thereof of the interlayer. The ignition source can also provide a voltage, current or combinations thereof to the interlayer. Moreover, the ignition source can provide heat to the interlayer. Preferably, actuation of the ignition source can allow the first and second reactive members of the nanoheater element to contact each other. Contact between the first and second reactive members yields at least one exothermic reaction.

In one embodiment, the second reactive member of the nanoheater element of the invention includes a layer or film. The second reactive member can comprise a thickness, for example, of about 10 to 100 nm. Preferably, the second reactive member can include a metal, metal oxide or combinations thereof. Exemplary metals or metal oxides for the second reactive member can include aluminum, iron oxide or combinations thereof. The invention also contemplates that the first and second reactive members of the nanoheater element can include any suitable materials, which yield at least one exothermic reaction on contact. For example, exothermic reactions between the first and second reactive members can produce high maximum temperatures and heating rates. Contact between the first and second reactive members of a nanoheater element can provide for self-propagating exothermic reactions.

Contact or interaction between the first and second reactive members of the nanoheater element of the invention can provide at least one exothermic reaction involving both atomic mixing and diffusion. For first and second reactive members comprising nickel and aluminum, respectively, contact between these members can yield, without limitation, $Ni_2Al_3$ and various nickel aluminides. In one embodiment, the nanoheater element of the invention can comprise a plurality of first reactive members. The interlayer of the nanoheater element can be disposed in communication with at least a portion of one first reactive member of the plurality thereof. The nanoheater element can also include a plurality of second reactive members. Preferably, at least one first and one second reactive member of the pluralities thereof can be separated by the interlayer. Each first and second reactive member of pluralities thereof can optionally be separated by at least one interlayer.

In one embodiment, the nanoheater element of the invention can comprise a plurality of first reactive members. The nanoheater element can also include a plurality of interlayers each of which can be disposed in communication with at least a portion of at least one first reactive member. Moreover, the nanoheater element can comprise a plurality of second reactive members. For example, each of the second reactive members of the plurality thereof can be separated from at least one first reactive member by at least one interlayer. As described, the first and second reactive members of the nanoheater element can include a layer or film. The first and second reactive members can have thicknesses, for example, of about 10 to 100 nm.

Additionally, the nanoheater element of the invention can comprise a valve member disposed adjacent to at least a portion of the first reactive member. The second reactive member can also be separated from the first reactive member by the valve member. The valve member of the nanoheater element can comprise, for example, a layer, film, membrane, device, conduit or combinations thereof. In one embodiment, the valve member can include devices or conduits through which the first and second members can interact or contact each other. Exemplary devices and conduits can include, for example, nanotubes, switches, flow through structures, gratings, microtubes, flaps and combinations thereof. The valve member can optionally regulate the extent or rate of contact between the first and second reactive members of the nanoheater element.

The invention also provides a nanoheater system comprising at least one nanoheater element. In one embodiment, the nanoheater system can include a plurality of nanoheater elements. Preferably, the nanoheater system also comprises a substrate. For example, exemplary nanoheater elements of the invention can be disposed on the substrate of the nanoheater system. Without limitation, at least two nanoheater elements of the nanoheater system can be in communication via an interconnect. The interconnect can be in communication with an ignition source that interacts with the interlayer of at least one nanoheater element. As described, the ignition source can provide for radio frequency pulsation, plasmonic induction, microwave excitation, infrared irradiation or combinations thereof of the interlayer.

In one embodiment, the ignition source can provide a voltage, current or combinations thereof to the interlayer of at least one nanoheater element of the nanoheater system of the invention. The ignition source can also provide heat to the interlayer. Furthermore, actuation of the ignition source can allow first and second reactive members of at least one nanoheater element to contact each other, yielding at least one exothermic reaction. Preferably, the interlayer of at least one nanoheater element comprises a plurality of pores. The first and second reactive members of at least one nanoheater element can contact each other through the plurality of pores of the interlayer. The nanoheater system of the invention can also include at least one controller.

An exemplary controller of the nanoheater system can interact with at least one nanoheater element. For example, the controller can regulate contact between the first and second reactive members of at least one nanoheater element. Preferably, the controller can regulate the flow of heat through the pores of an interlayer, thereby the amount of heat from one reactive member to another can be controlled. In one embodiment, the controller can provide a voltage, current or combination thereof to the interlayer, regulating atomic mixing or diffusion between the first and second reactive members. Moreover, the controller can regulate exothermic reaction kinetics between the first and second reactive members of at least one nanoheater element of the nanoheater system. The invention also provides a method of heating. Preferably, the method includes providing at least one nanoheater element or system of the invention. The method can comprise initiating contact between the first and second reactive members of at least one nanoheater element or system. Without limitation, the method includes producing heat through at least one exothermic reaction.

In general, nanostructures are defined herein as systems having a size of 1 micron or less, and more preferably can comprise discrete components having a size in a range of 1 nm to 100 nm.

A preferred embodiment of the invention includes systems and methods for fabricating nanorods and nanowires. These nanostructures can be used in the manufacture of nanoheater devices.

A preferred embodiment of a method of making nanorods and nanowires includes the formation of rods or wires in the pores of a membrane or template. In one embodiment aluminum and/or nickel can be formed in the pores of an anodized aluminum oxide membrane. The pores of the membrane preferably have a height to diameter ratio of 3 or less. In certain applications it is desirable to have this aspect ratio of height to diameter be 2 or less.

In a preferred embodiment, the membrane can be removed by etching to provide free standing nanorods or wires. Another embodiment provides for the formation of first and second reactive materials in each pore of the array. These materials may optionally be separated by an interlayer or barrier. The two materials can be formed on opposite sides or from the same side by different deposition techniques.

DESCRIPTION OF THE DRAWINGS

Other features and advantages of the invention may also be apparent from the following detailed description thereof, taken in conjunction with the accompanying drawings of which.

DETAILED DESCRIPTION OF THE INVENTION

The present invention provides nanoheater elements and systems, which can be used to produce heat. In one embodiment, the nanoheater element comprises a first reactive member. The nanoheater element also comprises an interlayer disposed in communication with at least a portion of the first reactive member. Moreover, the nanoheater element comprises a second reactive member. For example, the second reactive member can be separated from the first reactive member by the interlayer. Preferably, contact between the first and second reactive members of the nanoheater element can yield at least one exothermic reaction. The nanoheater element of the invention can optionally comprise a substrate over which the first reactive member is disposed.

Furthermore, a nanoheater element or system of the invention can be capable of providing intense, localized, rapid and controlled heating. In one embodiment, the nanoheater element or system can use exothermic reactions or transformations of reactive members or films. Preferably, these members are separated by at least one interlayer, for example, a dielectric or insulator interlayer, comprising transverse pores. An interlayer of a nanoheater element or system of the invention can comprise AAO, for example. An exemplary interlayer can provide for individual ignition as well as heat and mass transport control across the reactive members of a nanoheater element or system of the invention. The invention contemplates activation of the reactive members via electrical breakdown of at least one interlayer of a nanoheater element or system. For example, the reactive members can be exothermically reactive film heterostructures. The kinetics or thermodynamics in a nanoheater element or system can also be evaluated including, for example, interlayer nanoparticulates or intermetallic products.

Similarly, the invention contemplates controlling or regulating heat and mass transfer across an interlayer and between the reactive members of a nanoheater element or system. In one embodiment, a controller of a nanoheater element or system can be used to regulate the mass flow of molten reactants through at least one interlayer. For example, the mass flow of molten reactants through pores of an interlayer can be regulated under imposition of an electric bias control field across the reactive members. The invention also contemplates controlling or regulating electrokinetic, thermocapillary and diffusion based transport of reactive member melts through pores of an interlayer by imposition of electrical potential, temperature or concentration gradients as well as combinations thereof. Preferably, a nanoheater or system of the invention can be fabricated to deliver a specified heat flux or time-profile to a substrate thereof.

Figure 1:
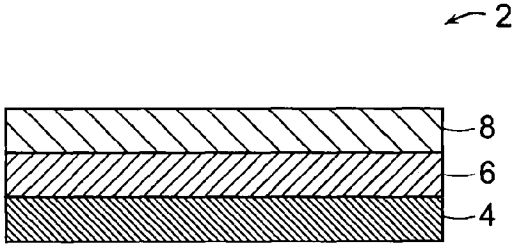
FIG. 1 is a representation of an exemplary nanoheater element of the invention.

FIG. 1 is a representation of an exemplary nanoheater element of the invention. As shown, the nanoheater element 2 comprises a first reactive member 4. The nanoheater element also includes an interlayer 6 disposed in communication with at least a portion of the first reactive member. The interlayer of the nanoheater element can comprise a membrane. Moreover, the nanoheater element comprises a second reactive member 8. For example, the second reactive member can be separated from the first reactive member by the interlayer. Preferably, contact between the first and second reactive members of the nanoheater element can yield at least one exothermic reaction. The nanoheater element can optionally include a substrate on which the first reactive member is disposed.

In one embodiment, fabrication of a nanoheater or system of the invention can comprise selection of an interlayer, reactive members and thicknesses thereof. With nanoheater elements of a nanoheater system of the invention, addressable arrays or custom interconnects can be used with time modulation of ignition and control signals, for example, temperature nanosenor feedback, to provide for three-dimensional distributed, dynamic thermal nanoprocessing fields. As described, an exemplary interlayer can comprise aluminum oxide films. In one embodiment, these films can include uniform nanopore arrays. The interlayer of a nanoheater element or system can also be obtained from anodizing high purity aluminum, for example.

For example, anodizing high purity aluminum can yield an interlayer comprising AAO. In one embodiment, a nanoheater element or system of the invention includes a layer, film, membrane, device, conduit or combinations thereof comprising AAO. A nanoheater element or system of the invention can include an AAO membrane comprising densely packed, hexagonally ordered arrays of parallel, non-intersecting nanopore channels, which may be perpendicular to at least one surface thereof. Exemplary nanopore channels can extend longitudinally through a layer, film, membrane or combinations thereof. A layer, film, membrane or combinations thereof can comprise an interlayer with a thickness from about 0 to 500 microns (μm). The interlayer can also comprise pores that include diameters from about 7 to 200 nanometers (nm) and, preferably, 40 to 50 nm.

The pores of a layer, film, membrane or combinations thereof of a nanoheater element or system of the invention can comprise a density from about 109 to 1011 pores per square centimeter and each be from about 90 to 110 nm apart. In one embodiment, these pores can be used to evaluate nanoscale flow therethrough or active electrokinetic modulation such as with a nanoheater element or system of the invention. As described, first and second reactive members can, for example, comprise nickel and aluminum, respectively. Exemplary intermetallic products of a nanoheater element or system of the invention include $NiAl_3$, $Ni_2Al_3$, NiAl, $Ni_3Al$ or combinations thereof. These intermetallic products comprise exothermic enthalpies, without limitation, from about −37.85 to −71.65 kilojoules per mole (kJ $mol^{-1}$) at ambient conditions.

In one embodiment, reactive members of a nanoheater element or system of the invention can comprise multiple films of nickel or aluminum. Exemplary members can include thicknesses from about 10 to 100 nm thick and be deposited by electron beam evaporation to overcome diffusion and heat loss. These members can also be ignited by ohmic heating. For example, an interlayer of a nanoheater element or system can interact with an ignition source capable of providing ohmic heating. The nanoheater elements or systems of the invention can provide for reliable, scalable and affordable in-situ heating sources that may be used in nanopatterned thermal actuation or manufacturing of micro or nanoscale materials, devices, systems or combinations thereof.

Figure 2:
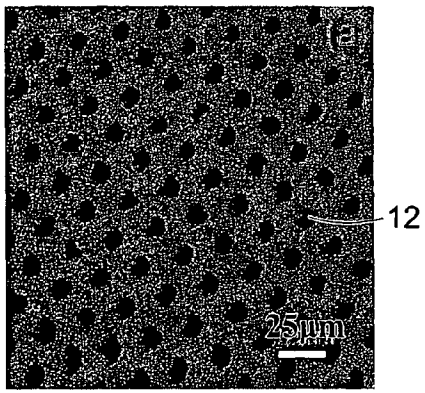
FIG. 2 is an atomic force microscope (AFM) image of an exemplary interlayer of the nanoheater element in FIG. 1.
Figure 3:
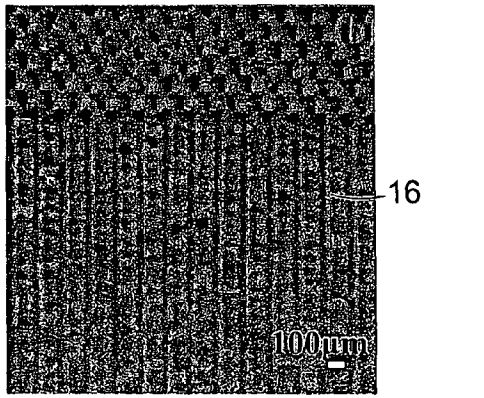
FIG. 3 is a cross-section scanning electron microscope (SEM) image of the exemplary interlayer in FIG. 2.

FIG. 2 is an atomic force microscope (AFM) image of an exemplary interlayer of the nanoheater element in FIG. 1. As shown, the interlayer 10 comprises AAO and can include a thickness of about 10 to 100 nm. The interlayer also includes a plurality of pores 12. For example, the pore can include a diameter from about 10 to 50 nm. The interlayer can also comprise at least two pores with diameters, for example, from about 10 to 50 nm. The pores of the interlayer can each be from about 50 to 100 nm apart. FIG. 3 is a cross-section scanning electron microscope (SEM) image of the exemplary interlayer in FIG. 2. As shown, the interlayer 14 comprises a plurality of pores 16. In one embodiment, a nanoheater element or system of the invention can comprise an interlayer that includes at least one pore. Systems and methods for the fabrication of porous anodized aluminum oxide can be founding Galca et al., "Structural and optical characterization of porous anodic aluminum oxide", Journal of Applied Physics, 94, 4296 (2003), the entire contents of which is incorporated herein by reference.

Preferably, a nanoheater element or system of the invention comprises a plurality of alternating reactive members. As described, these reactive members can each comprise layers of nickel or aluminum. In one embodiment, the reactive members can be provided via any suitable conventional technique or process including laser, plasma, electrochemical deposition processes or combinations thereof. For example, the reactive members of a nanoheater element or system can be deposited on a substrate. Exemplary substrates comprise semiconductor wafers, insulators, ceramic films, polymers or combinations thereof. A nanoheater element or system of the invention can also comprise an interlayer comprising an insulator such as, for example, aluminum oxide or AAO. The interlayer can be grown between each pair of reactive members by surface oxidation of aluminum.

Figure 4:
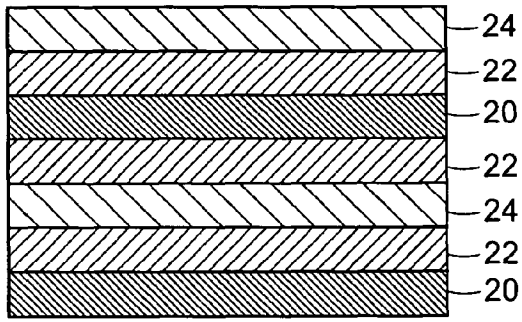
FIG. 4 is a representation of an exemplary nanoheater element of the invention.

FIG. 4 is a representation of an exemplary nanoheater element of the invention. The nanoheater 18 can comprise a plurality of first reactive members 20. The interlayer 22 of the nanoheater element can be disposed in communication with at least a portion of one first reactive member of the plurality thereof. Moreover, the nanoheater element can also include a plurality of second reactive members 24. Preferably, at least one first and one second reactive member of the pluralities thereof can be separated by the interlayer. Each first and second reactive member of pluralities thereof can optionally be separated by at least one interlayer. The nanoheater element can also include a plurality of interlayers each of which can be disposed in communication with at least a portion of at least one first reactive member. As described, the first and second reactive members of the nanoheater element can include a layer or film comprising thicknesses, for example, of about 10 to 100 nm.

The reactive members of a nanoheater element or system of the invention can comprise a plurality of bimetallic pairs of nickel and aluminum. A nanoheater element or system of the invention can be lithographically patterned and etched into custom designed islands or interconnected arrays of nanoheater pads. For example, nanoheater elements can be deposited on the surface or embedded within the volume of layered structures during fabrication thereof. In one embodiment, a nanoheater element can be covered by at least one insulating film such as silicon dioxide. Preferably, with external ignition, a nanoheater element or system releases its reaction enthalpies as localized heat fluxes via thermal conduction to the substrate. The total amount and time profile of thermal power induced for a nanoheater element or system of the invention can be chosen through selected design or fabrication thereof.

For example, a nanoheater element or system of the invention can be selectively designed or fabricated based on the quantity, type and thickness of reactive members or interlayers. The invention also contemplates ignition of individually chosen nanoheater elements. A nanoheater element or system of the invention can be ignited through wired resistive or ohmic heating, electrical breakdown of interlayers or burst radio frequency pulsation. In one embodiment, radio frequency can be applied to arrayed nanoheater elements via interconnect. Alternatively, wireless plasmonic induction of reactive members can be used to initiate heating with a nanoheater element or system. Plasmonic induction can occur at plasmon wavelengths that relate to the quantity, type and thickness of reactive members or interlayers.

In one embodiment, microwave excitation or infrared irradiation, for example, on nanoheater element or system surfaces or infrared band transparent substrates, can be provided via surface gratings or antennae devices. After ignition of and heating with a nanoheater element or system, reacted or unreacted materials such as interlayer particulates can be either retained as structural or electrical interconnect elements in a device or etched therefrom. As described, a nanoheater element or system of the invention can also comprise a heat control configuration with a nanoporous AAO interlayer disposed between first and second reactive members that include nickel and aluminum, respectively. After fabrication of a nickel reactive member, a substantially pure, for example, at least 90 percent pure, aluminum film can be deposited and fully anodized to AAO.

Electrodeposition of aluminum can be provided to fill AAO nanopores with aluminum and build at least one aluminum reactive member. During operation of a nanoheater element or system, ignition of nickel and aluminum interfaces can be facilitated by, for example, electrical bursting of residual AAO interlayers at the nanopore ends adjacent to at least one nickel reactive members. Initially, heat generated at AAO and nickel interfaces can raise temperatures with the interlayer to the melting point of aluminum nanorods or nanochannels. The dissipation of aluminum ions into at least one nickel reactive member can result in a net flow of electrically charged, molten aluminum through AAO nanopores. In one embodiment, the flow of molten aluminum can be electrokinetically regulated by a controller, for example, an external direct bias current, that interacts with AAO nanopores or across the interlayer. Such a controller for a nanoheater element or system can regulate the rate of reactive heating.

Moreover, depending on nanopore diameters and bias current polarity, molten aluminum flows and thermal release can be accelerated, decelerated or combinations thereof as well as halted and reignited, which may provide for subsequent reuse of a nanoheater element or system. The invention also contemplates monitoring decelerated heat release by, for example, arrayed thin film thermocouple arrangement across the substrate of a nanoheater element or system. In one embodiment, heat release can be monitored by infrared micro-pyrometer. Preferably, a nanoheater element or system of the invention can comprise temperature measurement and feedback, which can be used for real-time thermal control. A nanoheater element or system can optionally include in-situ hardware schemes, without limitation, CMOS-based analog microelectronics, or ex-situ closed loop algorithms.

FIG. 5 is a representation of an exemplary nanoheater system of the invention. As shown, the nanoheater system 26 comprises nanopores 28 in an interlayer. In one embodiment, the nanoheater system can comprise a valve member. The valve member of the nanoheater element can comprise, without limitation, a layer, film, membrane, device, conduit or combinations thereof. For example, the nanopores of the system in FIG. 5 can comprise an exemplary conduit. Other conduits for a valve member can include nanotubes, switches, flow through structures, gratings, microtubes, flaps and combinations thereof. Valve members can optionally regulate the extent or rate of at least one exothermic reaction.

The nanoheater system 26 in FIG. 5 also includes an insulator 30. Preferably, a first reactive member 32 of the system is disposed on a substrate 34. The nanoheater system also comprises at least one thermocouple 36 or pyrometer 38 and combinations thereof. The pyrometer is a non-contact infrared pyrometer. In one embodiment, the nanoheater system comprises an ignition source and controller 40. Exemplary ignitions sources and controllers for a nanoheater element or system of the invention can be part of an individual device. Alternatively, an ignition source or controller can comprise separate devices that interact with the interlayer of a nanoheater element or system. Moreover, the ignition source can interact with the interlayer of the nanoheater system. The ignition source can provide for radio frequency pulsation, plasmonic induction, microwave excitation, infrared irradiation or combinations thereof of the interlayer.

Figure 5A:
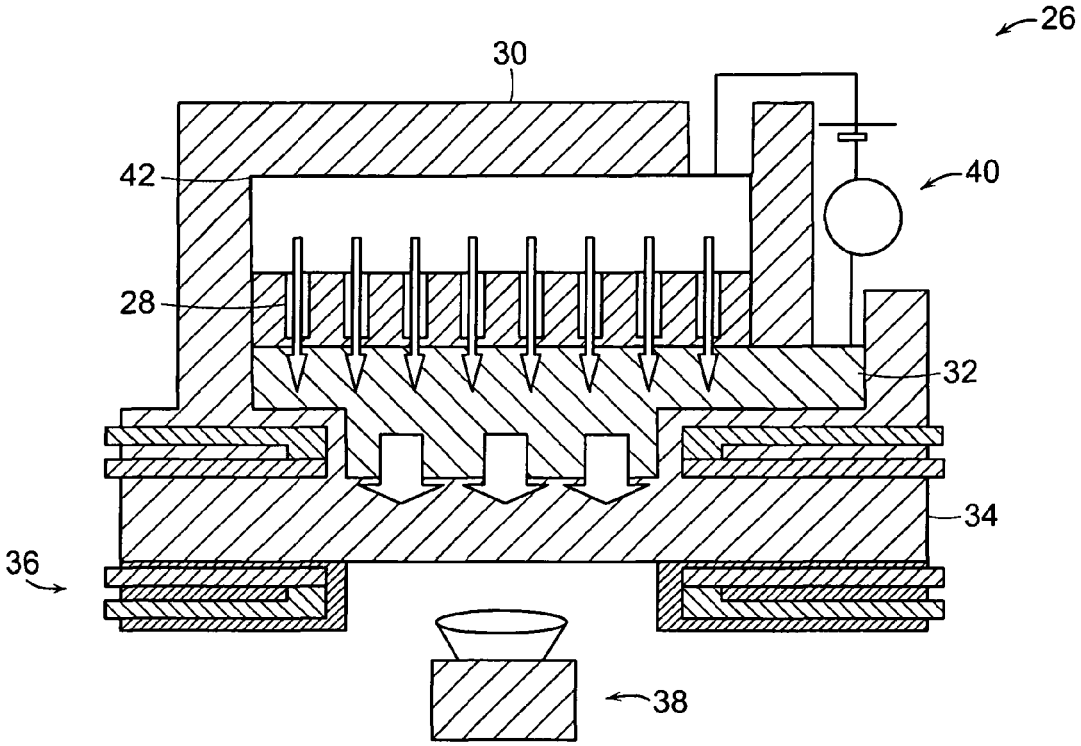
FIG. 5A is a representation of an exemplary nanoheater system of the invention.

Furthermore, the ignition source 40 in FIG. 5A can provide a voltage, current or combinations thereof to the interlayer of the nanoheater system 26. The ignition source can provide heat to the interlayer. In one embodiment, the ignition source interacts with the interlayer through a second reactive member 42 of the nanoheater system. The nanoheater or system can also comprise a first reaction member 32. Actuation of the ignition source can allow first and second reactive members of the nanoheater or system to contact each other, yielding at least one exothermic reaction. The first and second reactive members can contact each other through the plurality of pores 28 of the interlayer. The controller 40 of the nanoheater system can interact with the interlayer. For example, the controller can regulate contact between the first and second reactive members. Moreover, the controller can provide a voltage, current or combination thereof to the interlayer, regulating atomic mixing or diffusion between the first and second reactive members. The controller can also regulate exothermic reaction kinetics between the first and second reactive members of a nanoheater element for the nanoheater system.

With a one-dimensional analysis across the thickness of a nanoheater element or system of the invention, large area films of nickel and aluminum, for example, those 20 to 100 nm thick and in combinations corresponding stoichiometrically to nickel aluminides, can be provided by pulsed laser deposition, plasma sputtering or electrodeposition including simultaneous codeposition of nickel and aluminum on silicon and silicon dioxide coated wafers. In one embodiment, AAO interlayers of about 5 to 50 nm thick can be grown by anodic oxidation of electrodeposited aluminum, which can, for example, be substantially pure. The geometry and structure of layered nanoheater elements or systems as fabricated can be evaluated by transmission electron microscopy (TEM) and X-ray diffraction (XRD). For example, large patches of nanoheater elements can be separated by precision electrical discharge machining (EDM). Electrical interconnects can also be welded to the exposed layers by ultrasonic wire bonding.

Figure 5B:
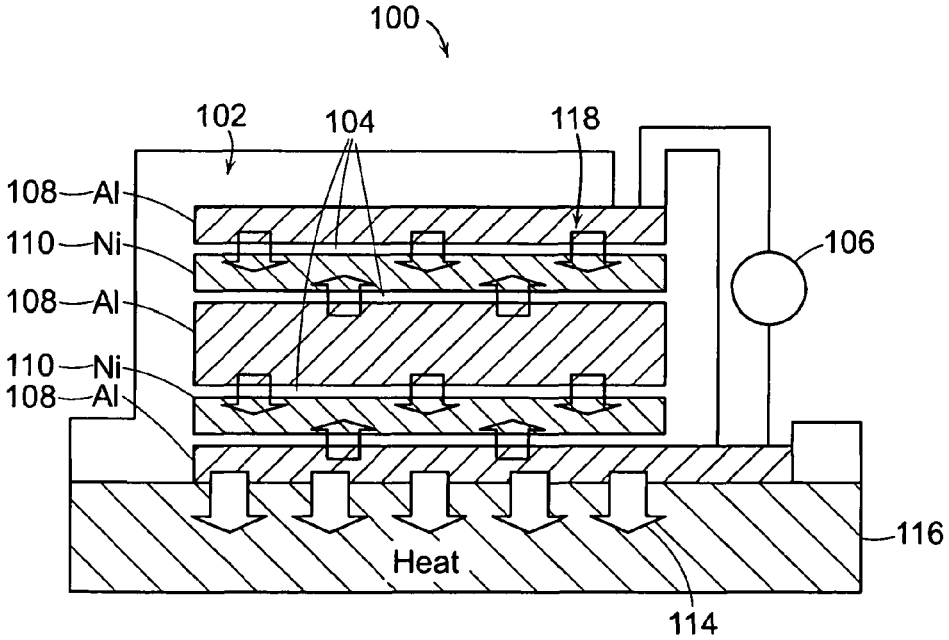
FIG. 5B illustrates a preferred embodiment of a layered nanoheater system in accordance with the invention.

FIG. 5B illustrates a layered nanoheater device 100 in which a plurality of layers of a first reactive material 108 are positioned around layers of a second reactive material 110. An interlayer or barrier 104 is positioned between the layers 108, 110 to separate the reactive components. An insulator 102 can surround the structure such that heat 114 is directed into the substrate 116. An ignition source 106 such as a voltage or RF source is connected to the layered structure to actuate the heating thereof.

Moreover, fabrication conditions such as temperature, pressure, concentration and current, can be systematically mapped to the nanoheater elements or systems. Preferably, layer growth rates, crystallographic orientations, dislocation densities and interface textures can be evaluated by TEM, x-ray diffraction (XRD) or AFM of sample sections. In one embodiment, parameters including surface preparation and pH can be related to an AAO interlayer. These parameters can be related to pore arrangements, diameters and interstitial lengths of the interlayer as measured by SEM and AFM. The invention also contemplates determining ignition and thermal performance of nanoheater elements or systems. For example, ignition and pore flows of individual nanoheater elements and terminals thereof can be connected to conventional power supplies and activated at progressively increasing radio frequency and direct current bias potential bursts. Thermal measurements of resulting, low-bandwidth heat flows into a substrate of a nanoheater element or system can also be evaluated. Contact thin film thermocouples can be electrodeposited and silicon dioxide insulators disposed on a wafer in a differential scheme, which may be connected to a high-speed data acquisition system. Non-contact infrared pyrometer in a wavelength range of about 2 to 12 μm can be provided on the backside of the substrate.

In one embodiment, the thermal performance and material transformation of nanoheater elements and systems can be evaluated by differential scanning calorimetry DSC or controlled isothermal slow heating combined with XRD analyses. For example, DSC can be used to characterize nickel and aluminum interdiffusion or formation of intermetallic structures as well as activation energies and reaction enthalpies released. The invention also contemplates thermal identification of heat fluxes via computational, model-based evaluations. Techniques for such thermal identification include Green-Galerkin approaches, using optimization of energetic residuals and Green's function interpolation, which can be adapted to identify impulsive, high-bandwidth heat influxes from nanoheater elements or systems to substrates thereof based on thermocouple or infrared pyrometry measurements.

Furthermore, mass and heat transport transient thermofluid analyses of nanoheater elements or systems can be performed. Reactive heat and mass transfer can be modeled or evaluated through a computationally efficient hybrid formulation that combines an atomistic one-dimensional description in a nanoheater element or system in the thickness direction with a continuum three-dimensional thermal model in a substrate thereof. For the heat source, a stochastic simulation approach such as a Monte Carlo approach based on statistical or Boltzmann mechanics and thermodynamics can be followed for ionic and electron diffusion, activation and reaction kinetics, thermal conduction or material transformations. Similarly, electrokinetic flows and charge transport through AAO interlayer pores can be described by quantum molecular dynamics (QMD) techniques, determining and including electronic forces in QMD density functional and Navier-Stokes equations.

To yield a specified heat flux cycle, multilayers of nickel and aluminum bimetallic pairs and insulator interlayers can be designed by quasi-linear deconvolution of experimentally observed impulse response functions. Preferably, conduction through underlying reacting regions can also be accounted for and evaluated. In order to obtain particular dynamic heat input distributions on the substrate surface of a nanoheater system, multi-element two-dimensional system topologies can be designed to include regular arrays and custom layouts of nanoheater elements with thermal resistive and capacitive elements. For example, exemplary nanoheater systems can be provided by spatio-temporal optimization of properly located, time-delayed and scaled temperature Green's functions. Optionally, nanoheater element arrays and tailored networks thereof can be patterned by mask projection and electron beam lithography. Individual nanoheater elements can also be etched to microscale or nanoscale sized, 10 μm and 50 to 100 nm, respectively.

Tuning of respective dynamics can be provided through the use of thermal capacitors, for example, metallic accumulators, and resistor or oxide insulator materials. In one embodiment, three-dimensional volume thermal sources consisting of multiple superposed surface source layers, separated by insulator films such as silicon and aluminum oxides can also be provided. A composite model of an integrated nanoheater system can use the thermal output of a one-dimensional nanoscale source model as an input to a multi-dimensional microscale thermal, material transport model of heated substrates. For relatively simple geometries, continuum convolution of adaptive Green's functions can be adopted. Similarly, with complex pattern and material configurations a finite element analysis (FEA) can be preferred. Such models can be used for design of real-time distributed-parameter system (DPS) thermal controllers, modulating the ignition timing and regulation current in nanoheater element arrays and networks thereof to obtain a specific dynamic temperature field. The invention also contemplates use of Green-Galerkin DPS controllability algorithms.

Exemplary models for a nanoheater element or system of the invention can be used for in-process DPS thermal observation or deriving and providing feedback on internal thermal distributions in a substrate based on surface temperature measurements obtained via thermocouple and pyrometric sensors. Exemplary materials for reactive members and substrates include, without limitation, nanopowders, nanofibers, nanotubes and porous media. Besides nickel and aluminum reactive member pairs, the invention also contemplates members comprising, for example, energetic metal oxide-aluminum and biocompatible titanium-aluminum. Moreover, with parallel to planar two-dimensional substrates, reactive member coating and heating can be applied to metal oxide and refractory alloy nanopowders, ceramic nanofibers, magnetic or semiconducting nanowires, carbon nanotubes and meso or microporous scaffolds including zeolites and aerogels, producing nanostructured sintered consolidates, metal-matrix nanocomposites, thermally and electrically connected networks or lightweight heat sources.

In one embodiment, a nanoheater element or system of the invention can be used to demonstrate nano and multi-scale thermodynamics, reaction kinetics, metallurgical and material transformations, surface science and engineering, heat transfer, electrofluidic transport and thermo and material modeling or control as well as design and manufacturing. The invention also contemplates visualizing macro-scale functional rapid prototyping and scaling laws including nano or multiscale phenomena. Such visualizations can employ multi-jet modeling, three-dimensional printing and laminated object manufacturing with multiple materials such as acrylic, wax or paper and embedded ohmic heaters and thermocouples. A nanoheater element or system of the invention can also interact with conventional process controls and computer systems for manipulation thereof.

Figure 6:
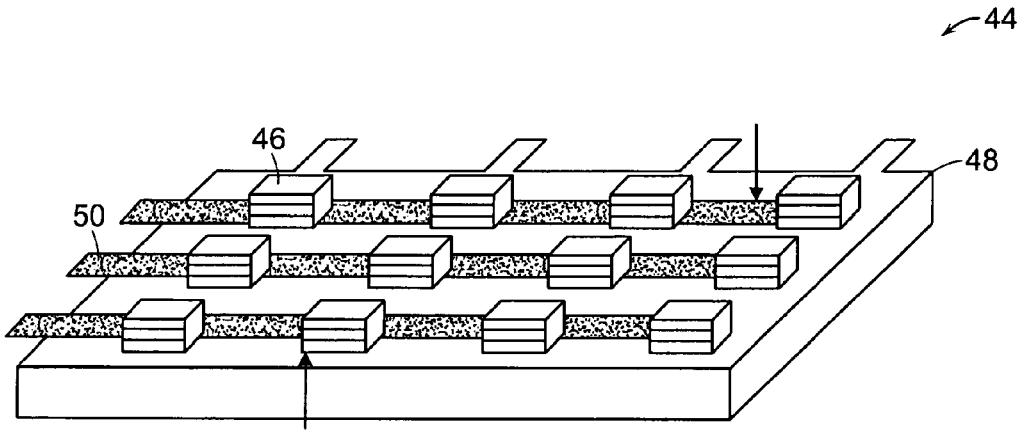
FIG. 6 is a representation of an exemplary nanoheater system of the invention comprising an array of the nanoheater elements.

FIG. 6 is a representation of an exemplary nanoheater system of the invention comprising an array of the nanoheater elements. As shown, the nanoheater system 44 comprises plurality of a nanoheater elements 46. The nanoheater elements are disposed on a substrate 48 in an ordered array. The nanoheater system also comprises interconnects 50 between individual nanoheater elements. Preferably, the interconnects can be in communication with an ignition source that interacts with the interlayer of at least one nanoheater element. Exemplary ignition sources can provide for radio frequency pulsation, plasmonic induction, microwave excitation, infrared irradiation or combinations thereof of the interlayer to initiate contact between a first and second reactive member of a nanoheater element.

Figure 7:
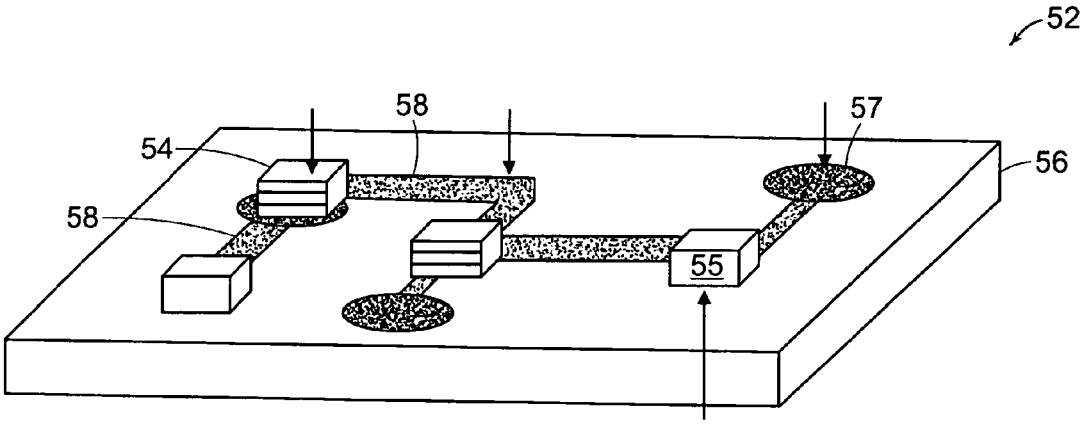
FIG. 7 is a representation of an exemplary nanoheater system of the invention comprising an array of the nanoheater elements.

Similarly, FIG. 7 is a representation of an exemplary nanoheater system of the invention comprising an array of the nanoheater elements. As shown, the nanoheater system 52 comprises a plurality of nanoheater elements 54. The nanoheater elements are disposed on a substrate 56 in a custom array. The nanoheater system also comprises interconnects 58 between individual nanoheater elements. For example, the interconnects can be in communication with an ignition source that interacts with the interlayer of at least one nanoheater element. In one embodiment, the ignition source can provide a voltage, current or combinations thereof to the interlayer of at least one nanoheater element of the nanoheater system of the invention. The ignition source can also provide heat to the interlayer. Actuation of the ignition source can allow first and second reactive members of at least one nanoheater element to contact each other, yielding at least one exothermic reaction. The interconnects 58 can be heat conductive and can connect to a heated junction 57, where heat can be coupled to system 52 and-or a thermal reservoir 55.

For example, nanoheater source elements in conjunction with thermal capacitance masses and thermal resistance conductors can be used to tune the temporal thermal dynamics of heat release at a certain location of the substrate (e.g., for slowing down the heating profiles), or for spatial time-sequencing of the heat release at a number of substrate locations (e.g., to obtain progressive propagation of heat along a path on the substrate or a discrete series of heating events in a domino-like sequence) or a combination of temporal-spatial conditioning of heat release as described. Such elements can be needed in serial thermal processes such as the polymerase chain reaction (PCR) and various thermo-electromechanical systems involving mechanical motion or electrical activity produced by a nanoheater or system of the invention.

A nanoheater element or system of the invention can be used in applications that include, for example, nano-manufacturing processes in semiconductor fabrication, rapid solidification of materials, thermal lithography, nanoscale joining or molding. These applications can comprise joining of micro or nano-components including nanoscale welding, soldering or bonding for assembly and packaging (microelectromechanical systems). Deformation and flow-based geometric shaping can also be performed using nanoheater elements or systems of the invention. Moreover, the invention also contemplates rapid solidification processing and heat treatment of nano-grained alloys and nanostructured phase materials applications, rapid thermal processing for doped semiconductor annealing, oxidation, CVD in micro or nanoelectronics or thermally-based nanolithography techniques. Applications of nanoheater elements or systems can include in-service actuation of autonomously powered, functional devices and systems such as those that are nanomechanical, fluidic, chemical, biomedical, thermoluminescent, thermionic and nanoelectronic.

Additionally, the invention contemplates thermally powered mechanical nanomotors and nanorobots via heating of bimetallic cantilevers for in-plane and off-plane translation and rotation or micro nanofluid pumps. The nanoheater elements or systems of the invention can also be used for electrical power generation in conjunction with thermoelectric nanocomposite materials (thermal nanobatteries), patterned electronic and optical emitter artifacts in combination with thermionic and thermoluminescent materials for nanoscale experimentation as well as chemical and biochemical temperature control, for example, in catalytic microreactors and polymerase chain reaction (PCR) DNA amplification in biodetectors and biomedical devices.

In one embodiment, a nanoheater element or system can use energetically milder coating processes such as electroplating or intermediate separator layers. The invention also contemplates scaling reactive members to be stable or at a thickness capable of self-sustainable reactions. Scaling of reactive members can be based on experimental and empirical analyses. Preferably, Debye lengths for molten aluminum reactants can be comparable to those of ionic solutions electrokinetically transported via pores similarly sized to an interlayer. The invention can employ proper design of AAO interlayer thicknesses, pore sizes and distributions. Alternatively, nano-channeled materials can be used for a nanoheater element or system including block copolymer-templated oxides.

In microelectronics, the fine selectivity and fast control of nanoheater elements or systems can provide reductions of thermal budgets and superior processing quality in annealing, oxidation or CVD of semiconductors. For example, given conventional equipment, sputtering systems in standard semiconductor facilities and thermal self-processing of electronics with layered source patterns can obviate the compromised performance and expense of both RTP reactors and furnaces. Similarly, self-heatable nanomaterials including powders, fibers, tubes or platelets coated with reactive members can provide for unique consolidation routes of nanostructured and nanocomposite materials. An entire armory of macro-thermal manufacturing processes such as welding, molding and ablation can be scaled down and provide by a nanoheater element or system of the invention. Exemplary nanoheater elements or systems can also provide in-situ reactive source technology that may be used to power nanodevices and Microsystems, chemical sensors and biomedical aids.

Figure 8:
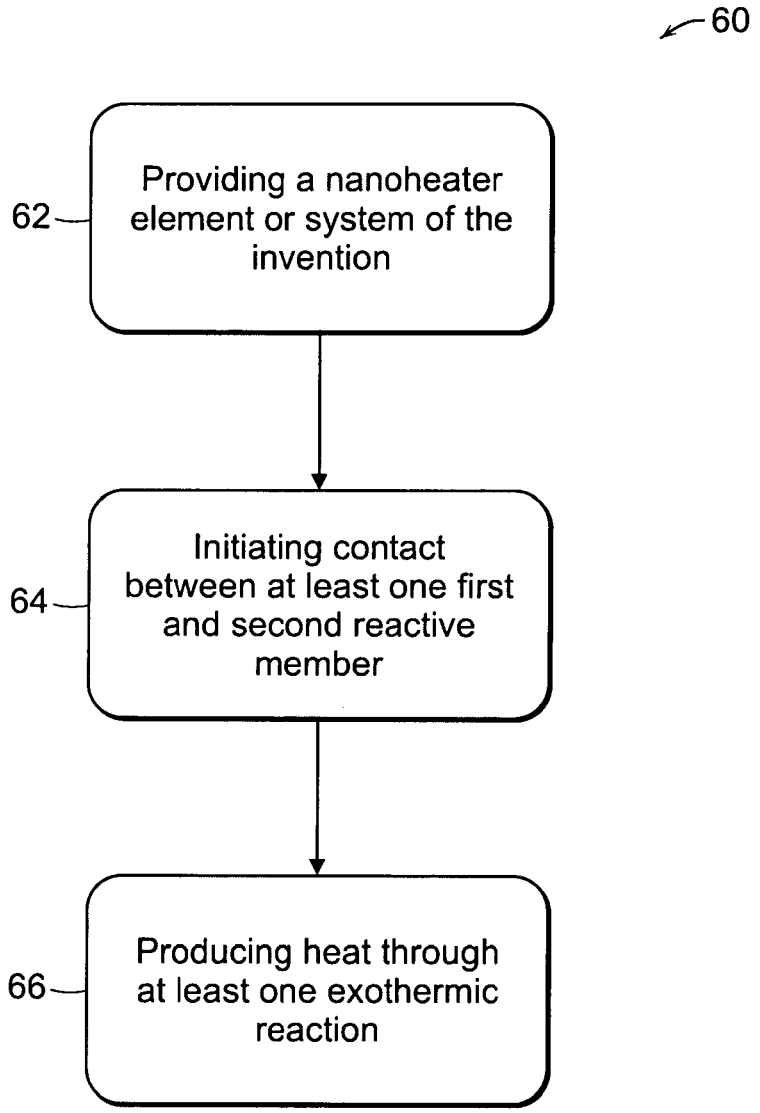
FIG. 8 is a representation of a method of the invention.

The invention also provides a method of heating. FIG. 8 is a representation of a method of the invention. As shown, the method 60 includes providing at least one nanoheater element or system of the invention in step 62. For example, the method can comprise initiating contact between the first and second reactive members of at least one nanoheater element or system in step 64. Preferably, the method includes producing heat through at least one exothermic reaction in step 66. The method can be used for fine local heat selectivity. The method of the invention can optionally involve a plurality of nanoheater elements or systems, each of which is capable of providing heat through at least one exothermic reaction.

A preferred embodiment of the invention relates to systems and methods for the formation of ordered arrays of nanostructures, such as nanowires, nanorods, nanopillars and nanodots. In order to control the properties of the nano-devices, it is important to control the size, shape and density of the nanostructures, using a procedure applicable to a wide range of materials, which also allows processing of large areas. Furthermore, high throughput and low cost is desirable in many applications.

A preferred method for the fabrication of nanomaterials utilizes the formation of nanostructures within a template or preformed structure. In this method materials are deposited inside the features of a nano-template and they obtain the shape and size of these features. Diblock copolymers, poly (styrene) spheres, track-etched membranes, and porous alumina membranes are preferred embodiments of nano-templates. Porous alumina membranes can be formed on Al or other substrates, on which Al layers have been predeposited, by anodization of Al foils, for example. Al films can be deposited on substrates using acidic electrolytes, such as phosphoric, oxalic or sulfuric acid. Such alumina membranes can display ordered arrays of vertical cylindrical pores, homogeneously distributed in hexagonal close-packed arrays. A hemispherical barrier-layer of compact alumina can form at the bottom of the pores, with a thickness which is half of the pore wall thickness. This barrier-layer can be dissolved chemically in phosphoric acid, allowing the pores to extend to the substrate. The structural characteristics of the pores are controlled by the anodization conditions, i.e., the pore diameter and height as well as the distances between them can be tuned by selecting the appropriate electrolyte, anodization voltage and duration. Moreover, after the fabrication of the porous alumina film, the diameter of the pores can be widened even more by chemical etching in phosphoric acid which can also be used to dissolve the barrier-layer.

Porous alumina exhibits several attractive advantages as a template material. Ordered nanochannels with tunable diameter, length and density can be fabricated in which the structural characteristics of each pore are almost identical, and both diameter and density can be precisely adjusted in the range from 5-200 nm and $10^{10}$-$10^{12}$ pores/cm$^2$ respectively. Such high densities, which cannot be achieved with lithographic techniques, are necessary for various applications, such as memories and optoelectronic devices. Furthermore, porous alumina membranes can be fabricated on large areas of several square centimeters and can be either grown directly on Al or other substrates; or they can be fabricated free-standing and then placed on any kind of substrate. This allows the growth of nanostructures on any kind of substrate. After the formation of the nanostructures, the porous alumina template can be either used as an insulator between them, or alternatively, the template can be chemically dissolved, to free the nanostructures.

The height of the pores corresponding to the thickness of the porous alumina template can depend on the duration of the anodization procedure. Generally, the most homogeneous pore distributions are obtained at longer anodization times, i.e., within thicker porous alumina films, above several hundreds of nanometers, where the system has enough time to self-organize to a more ordered structure. However, higher thicknesses are associated with higher pore aspect-ratio. High-aspect ratio pores are very difficult to be completely filled, especially with physical deposition techniques, due to the pore closure effect. Initially, the deposited material enters the pores and reaches the bottom, but as the deposition progresses, the material accumulates on the upper parts of the pore walls close to the surface, causing a continuous shrinkage of the pore diameter, until the pore entrance is blocked completely. For this reason electrochemical methods, and mainly DC or AC electrodeposition, are used for the fabrication of nanowires and nanorods inside the pores of a porous alumina template. Electrochemical methods allow for complete filling of the pores quickly and economically, having a high yield and throughput. However, they are not applicable to all kinds of materials, since only some metals and compound semiconductors can be electrodeposited. There are important materials that are very difficult, or even impossible, to be electrodeposited. One of these is AI, which is extremely difficult to be electrodeposited. Al nanoparticles are very important for many applications, such as nanoelectronic devices, or in the study of conductivity at the nanoscale.

Ordered Al nanorods deposited on a ceramic or polymer substrate can be used to modify its optical and plasmonic properties, including electrical conductivity through electron tunneling etc. Furthermore, bimetallic AI/Ni heterostructures form a reactive pair with exothermic formation enthalpies of their intermetallic compounds. Thus a preferred embodiment of the invention provides for the formation of exothermically reactive bimetallic nanorods. As free-standing structures such nanorods can be incorporated in composite materials and be ignited externally by RF or IR, yielding a self-heating material where the heat distribution can be externally controlled by selective ignition irradiation. The nanorods inside the alumina template can be sandwiched between two metallic interconnect line grids, formed lithographically and running perpendicular to each other, therefore yielding a cross-bridge array of reactive islands (each containing a number of nanorods) that can be individually ignited by RF voltage to the proper interconnect lines. This can be used for rapid thermal processing at the nanoscale, thermal nanobatteries for MEMs devices, chemical sensors and biomedical devices.

Electrochemical deposition of Ni inside the alumina pores can be used, however, electrochemical deposition of Al is extremely difficult. A preferred embodiment utilizes evaporation deposition for the formation of Al in an alumina template. For this reason, ultra-thin porous alumina templates were fabricated on Si substrates, with thicknesses and pore diameters in the range from 50-70 nm and 20-40 nm, respectively. These pores had a very low diameter to height aspect-ratio in a range of 1:1.5 to 1:3, and they were completely filled with metals deposited by electron gun evaporation. The filling of the pores with Au and Al are used in the fabrication of nanorods.

Figure 9A:
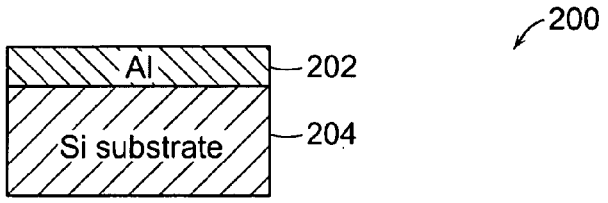
FIGS. 9A-9G illustrate a process flow sequence for the fabrication of nanorods or wires inside the channels or pores of a template.

For the fabrication 200 of thin porous alumina templates with low aspect-ratio pores, a ultra-thin Al film 202, with thickness of 30 and 50 nm, were deposited on p-type (100) Si substrate 204 by electron gun evaporation (FIG. 9A) and then anodized. Anodization of such thin films is very quick being complete in only a few seconds, and can require specific voltages to provide the desired thickness for small thicknesses, very low voltages are needed, otherwise the newly formed alumina dissolves due to the strong electric fields. However, under careful tuning of the conditions, anodization of Al films with thicknesses between 10 and 50 nm have been formed. Thin films are preferred in order to achieve low aspect-ratios that are better suited for growth of the preferred structures. The self-organizing nature of anodic porous alumina allows the process to create pores 208 with diameters in the range from 5 to about 50 nm in the case of the anodization conditions, and can reach up to 100 nm-200 nm under selected conditions. This means that the height of the pores probably does not exceed 70-150 nm for the wider pores, in order to obtain low diameter to height aspect-ratio structures. Narrower pores have a lower height as the height of the pores, i.e., the thickness of the porous alumina film, depends on the thickness of the anodized Al film deposited on the Si substrate. The obtained alumina film is thicker than the Al due to the oxidation; e.g., Al films 30 nm thick result in porous alumina 45-50 nm thick, while Al films 50 nm thick result in porous alumina about 60-70 nm thick.

Figure 9B:
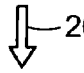
Figure 9B:
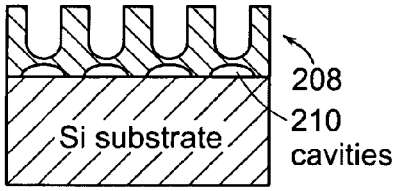
Figure 9F:
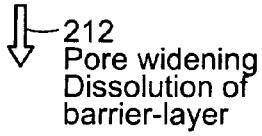
Figure 9F:
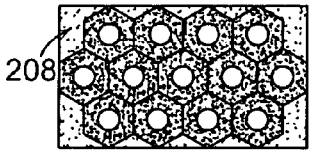
Figure 9C:
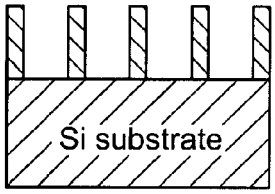

The Si-based Al films are set as the anode in an appropriate anodization cell, while a platinum electrode serves as the cathode, and they are anodized 206 under constant voltage (FIG. 9B). As mentioned above, to anodize such thin films it is desirable to use very low voltages; otherwise the newly formed alumina films dissolve immediately due to the strong electric fields. On the other hand, the voltage is preferably as high as possible, because the diameter of the pores 208 is proportional to the anodization voltage, and pores as wide as possible are needed to achieve a low aspect-ratio, as shown in the top view of FIG. 9F. At low voltages, between 20 and 30 V, the most appropriate electrolyte is sulfuric acid. Oxalic and phosphoric acid are used for anodization under higher voltages, in a range of 30 to 60 V for oxalic acid and 90-100 V for phosphoric acid. Preferably, anodization was realized in sulfuric acid aqueous solution, 10% v.v., under constant voltages of 20, 25 and 28 V. Pore widening 212 followed in a phosphoric acid aqueous solution (10% in weight) for various durations (between 5 and 30 minutes), in order to obtain the widest pores possible, before they start merging with each other (FIG. 9C).

Figure 9G:
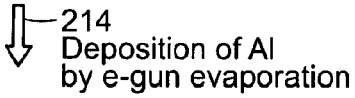
Figure 9G:
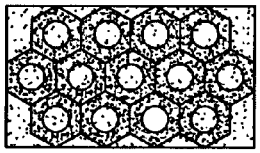
Figure 9D:
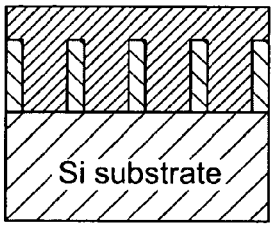

The porous alumina films obtained were characterized by scanning electron microscopy (SEM) in order to estimate their pore diameter. Those with larger pores were used as templates for deposition 214 of metals inside the pores by electron gun evaporation (FIG. 9D). The evaporation was realized under high vacuum conditions (base pressure at about $10^{-7}$ mbar), in a basic molecular beam epitaxy system, equipped with 2 electron guns; the direction of the beam was vertical to the sample surface. The deposition was performed at room temperature, with a deposition rate of 8 angstroms/sec and a total thickness of 200 nm.

After evaporation, selected structures were prepared for cross-sectional transmission electron microscopy (TEM). A cross-sectional bright field TEM image was used to verify that a very thin porous alumina film on a Si substrate was obtained after a pore widening step. This porous alumina film was fabricated by anodization of a 30 nm thick Al film under constant voltage of 20 V, while pore widening, shown also in FIG. 9G, followed in phosphoric acid for 15 minutes. In this case the average pore diameter was about 20 nm. This template was used for the deposition of Al and Au inside the pores by electron gun evaporation. The barrier-layer was completely dissolved during the pore widening step and the pores reach straight to the substrate. Moreover, the pores are wider at the bottom. This occurs when porous alumina is formed on substrates other than Al. In these cases, a cavity 210 is formed inside the barrier layer, underneath each pore, with a larger diameter than that of the pore. When the barrier-layer is dissolved, the cavity 210 merges with the pore, forming this shape.

A dark-field TEM image of a cross-section of a porous film after the Al deposition demonstrates that Al has completely filled all the pores, while the rest of the Al has formed a continuous Al film above the porous alumina template. In this case, the height of the pores (and Al nanorods also) is 60 nm, while their diameter is about 30-40 nm, i.e., their diameter to height aspect-ratio is in a range of about 1:1.5-1:2.

Note that in TEM dark field imaging, diffraction contrast is produced by the volume of the crystallites that are diffracting towards a specific direction (different than the direction of the transmitted beam). The white areas in a dark field image indicate the crystallites that have the right orientation in order to diffract the electron beam towards the selected specific direction. When, under the same conditions, another of the diffracted beams is selected, another set of crystallites that have a different orientation than the first set can be imaged. By superimposing various dark field images that come from the same volume, a more complete view of the distribution of crystallites in that volume is provided. When two different dark field images of the same volume are superimposed, this demonstrates that (crystalline) Al has completely filled the pores, since it is detected at both the bottom and the top of the pores. Note that amorphous alumina cannot diffract and therefore cannot be bright in this kind of imaging. In this example of a thinner porous alumina template on a Si substrate, 40 nm thick, the diameter of the pores (and nanorods) in this case is about 20-25 nm, i.e., the aspect-ratio is about 1:1.6-1:2. Generally it is preferred that the ratio of the diameter to height is 1:3 or less. Au nanorods have been deposited in the pores of a porous alumina template 60 nm thick.

Figure 9E:
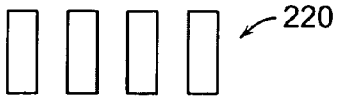

After the formation of nanorods, the porous alumina template can be chemically dissolved, as shown in FIG. 9E, leaving free-standing nanorods 220. In the case of Al nanorods, a mixture of phosphoric and chromic acid can be used, which can be used to selectively etch alumina but not aluminum. This technique can also be used for the formation of bimetallic nanorods, such as exothermically reactive Al/Ni nanorods, to fabricate nano-heaters.

To fabricate free standing Ni—Al bimetallic nanowire nanoheaters using chemical methods or a combination of physical and chemical methods. Due to the difficulty in electroplating Al, two methods are combined are used to obtain free-standing nanowire nanoheaters. The first approach is using e-beam evaporation of Al inside AAO pores and then electrodeposition of Ni. A preferred embodiment first uses e-beam evaporation to fill AAO membrane pores partially with Al segment, and then obtain the second segment with Ni via electrodeposition. The length of both segments can be controlled by adjusting evaporation time and electropolating time. An intermediate step can be used to form a barrier or interlayer between the Al and Ni portions of each rod.

A second method is to fill AAO pores with Al nanoparticles with a sedimentation method, using either vacuum or spin coating to enhance particle filling. High temperatures can then be used to melt or sinter nanoparticles in an inert environment (e.g., nitrogen) to form continuous Al segments. Ni is then electroplated to form Ni—Al bilayer nanowires. In this sedimentation approach, Al nanoparticle suspension and stabilization in fluids can be used in obtaining uniform Al layers in AAO pores. Ultrasonication and/or self-assembled monolayers can be used to assist in de-aggregation and stabilization of nanoparticles in solutions.

After fabrication, the nanowire nanoheaters can be either left embedded in the AAO templates for ignition and characterization, or released from AAO templates and stored in liquid suspensions for further assembly or processing. If Ni—Al nanowires are released from AAO templates after fabrication, they can be combined into heating arrays or systems.

Sputtered multilayered foils of Al and Ni is a preferred method due in part to the relatively high deposition rates in sputtering which vary linearly with target power and are typically of the order of a few hundred nm per hour for Al and Ni. The alternating Al and Ni layers in these foils are typically 10-200 nm thick. Small interlayer spacings assure easy ignition and self-propagating conditions for the exothermic Ni-aluminide forming reaction in the foil. Once ignited, the reaction propagates at the rate limited by the interdiffusion in the melt created at the reaction front. The steady-state self-propagation stage of the reaction in a multilayered foil has a propagation rate that depends inversely on the layer spacing in the foil.

A method to regulate the reaction rate of nanoheaters is to use a reaction-barrier membrane or interlayer between the reacting layers of Al and Ni. Nanoporous AAO membranes are one choice for such a barrier. Similarly, in the multi-layer foils, controlled surface oxidation of each Al layer prior to deposition of a Ni layer create an insulating layer that can be used to control the ignition barrier. Another preferred method involves designing the substrate or media into which the nanoheaters are embedded. For example, nanowires separated from the AAO membrane can then be mixed into polymer fibers (e.g., via electrospinning) or into droplets that serve dual purpose as the carrier and as the barrier to ignition. Electrospinning is a high-rate process for creating continuous nanofibers from solution utilizing an electric field. The process can be controlled to obtain aligned, patterned, and helically-wound fibers incorporating nanoparticles into the fiber. Dispersion using a sufficiently high loading beyond the percolation threshold is desirable for continuous reaction propagation along the fiber. These nanofiber heaters can be used for applications where a flexible, continuous line, 2D or 3D patterned nanoheaters are desired. The fiber carrier can also serve as a barrier to undesired ignition.

While the present invention has been described herein in conjunction with a preferred embodiment, a person with ordinary skill in the art, after reading the foregoing specification, can effect changes, substitutions of equivalents and other types of alterations to the elements, systems and methods of the invention as set forth herein. Each embodiment described above can also have included or incorporated therewith such variations as disclosed in regard to any or all of the other embodiments. Thus, it is intended that protection granted by Letters Patent hereon be limited in breadth and scope only by definitions contained in the appended claims and any equivalents thereof.

What is claimed is:

1. A nanoheater element comprising:

a first reactive member; and a second reactive member separated from the first reactive member by an electronically actuated valve member, the valve member comprises at least one pore having an aspect ratio and a diameter from about 7 to 200 nm that is enclosed on a first side by the first reactive member and enclosed on a second side by the second reactive member such that electrical actuation of the valve yields at least one exothermic reaction through the at least one pore between the first reactive member and the second reactive member.

2. The nanoheater element of claim 1, wherein the valve member comprises a layer, film, membrane, device, a fibrous layer, conduit or a combination thereof.

3. A method of heating comprising:

initiating an exothermic reaction between at least one first reactive member and one second reactive member of a nanoheater with a valve element, the valve element including a plurality of pores of a membrane positioned between the at least one first reactive member and the second reactive member wherein the at least one first reactive member has a thickness in a range of 10-100 nm;

actuating the valve element to initiate contact between one first reactive member and one second reactive member; and producing heat with the nanoheater through the at least one exothermic reaction.

4. The method of claim 3 further comprising using radiation or an electrical current to initiate the reaction.

5. A nanoheater comprising:

a first reactive member;

an interlayer in communication with at least a portion of the first reactive member, the interlayer having a plurality of pores, each pore with a diameter from about 7 to 200 nm; and a second reactive member separated from the first reactive member by the interlayer, the first reactive member and the second reactive member enclosing the plurality of pores such that an interaction between the first reactive member and the second reactive member can be initiated through the plurality of pores, each pore having an aspect ratio that yields at least one exothermic reaction between the first reactive member and the second reactive member.

6. The nanoheater of claim 5, wherein the first reactive member is positioned over a substrate.

7. The nanoheater of claim 6, wherein the substrate comprises a layer or film.

8. The nanoheater of claim 6, wherein the substrate comprises a thickness of about 10 to 100 nm.

9. The nanoheater of claim 6, wherein the substrate comprises silicon, metals, silicon dioxide, alloys, metal alloys, polymers, glass, refractory metal alloys, ceramics, insulators, composite materials or combinations thereof.

10. The nanoheater of claim 5, wherein the first reactive member comprises a layer or film.

11. The nanoheater of claim 10, wherein the first reactive member comprises a thickness of about 10 to 100 nm.

12. The nanoheater of claim 5, wherein the first reactive member comprises a transition metal, metal a combination thereof.

13. The nanoheater of claim 12, wherein the transition metal or metal of the first reactive member comprises nickel, aluminum, titanium, magnesium, chromium, cobalt, iron, cadmium, platinum, copper, rhenium or at least one combination of metals.

14. The nanoheater of claim 13, wherein the transition metal or metal of the first reactive member comprises nickel or aluminum.

15. The nanoheater of claim 5, wherein the interlayer has a thickness of about 10 to 100 nm.

16. The nanoheater of claim 5, wherein at least one pore comprises a diameter from about 10 to 50 nm.

17. The nanoheater of claim 5, wherein the pores comprise diameters from about 10 to 50 nm.

18. The nanoheater of claim 5, wherein the pores are from about 50 to 100 nm apart.

19. The nanoheater of claim 5, wherein the interlayer comprises a material including at least one of aluminum oxide, zeolites, AAO, aerogels, and a fibrous material or combinations thereof.

20. The nanoheater of claim 5, wherein the interlayer is coupled to an ignition source.

21. The nanoheater of claim 20, wherein the ignition source provides for at least one of radio frequency pulsation, plasmonic induction, microwave excitation, infrared irradiation to actuate ignition with the interlayer.

22. The nanoheater of claim 20, wherein the ignition source provides a voltage across at least one pore of the interlayer.

23. The nanoheater of claim 20, wherein the ignition source provides heat to at least one pore extending through the interlayer.

24. The nanoheater of claim 20, wherein actuation of the ignition source actuates contact between the first reactive member and the second reactive member.

25. The nanoheater of claim 5, wherein the second reactive member comprises a layer or film.

26. The nanoheater of claim 25, wherein the layer or film of the second reactive member has a thickness of about 10 to 100 nm.

27. The nanoheater of claim 5, wherein the second reactive member comprises a metal, metal oxide or combinations thereof.

28. The nanoheater of claim 27, wherein the metal or metal oxide of the second reactive member comprises aluminum or iron oxide.

29. The nanoheater of claim 5 further comprising:

a plurality of first reactive members;

an interlayer disposed in communication with at least a portion of one first reactive member; and a plurality of second reactive members, wherein at least one first reactive member and one second reactive member are separated by the interlayer and contact through the at plurality of pores in the interlayer initiates at least one exothermic reaction.

30. A method of forming a nanoheater comprising:

forming a membrane having a pore with a diameter from about 10 to 50 nm;

forming at least a first reactive material extending at least partially within the pore of the membrane;

forming a second reactive material positioned relative to the first reactive material; and reacting the first reactive material with the second reactive material by initiating an exothermic reaction through the pore, the pore having an aspect ratio and to form a nanoheater.

31. The method of claim 30 further comprising providing a membrane in which the pore has a height to diameter ratio that is 3 or less.

32. The method of claim 31 further comprising providing a plurality of pores in the membrane, each pore having an aspect ratio of height to diameter of 2 or less.

33. The method of claim 30 wherein the membrane comprises anodized aluminum oxide.

34. A nanoheater system comprising:

a plurality of nanoheater elements positioned over a substrate and including at least a first nanoheater element and a second nanoheater element, each nanoheater element having a first reactive layer with a thickness in a range of 10 to 100 nm, a second reactive layer, and an interlayer extending between the first reactive layer and the second reactive layer, the interlayer having a plurality of pores such that an exothermic reaction can be initiated through the pores;

at least one interconnect that conductively connects the first nanoheater element to the second nanoheater element; and a patterned conductive circuit formed over the substrate and electrically connected to at least one nanoheater element.

35. The nanoheater system of claim 34 wherein the conductive circuit electrically connects a plurality of nanoheater elements positioned on the substrate.

36. The nanoheater system of claim 35, wherein at least two nanoheater elements are electrically connected via an interconnect.

37. The nanoheater system of claim 36, wherein the interconnect is in communication with an ignition source.

* * * * *